United States Patent [19]

Cochran

[11] 3,986,186

[45] Oct. 12, 1976

[54] AUTOMATIC DISPLAY SEGMENT INTENSITY CONTROL

[75] Inventor: David S. Cochran, Palo Alto, Calif.

[73] Assignee: Hewlett-Packard Company, Palo Alto, Calif.

[22] Filed: Dec. 23, 1974

[21] Appl. No.: 535,311

[52] U.S. Cl. ..... 340/335; 340/336

[51] Int. Cl.[2] ..... G09F 9/32

[58] Field of Search ..... 340/324 R, 324 M, 336, 340/335, 340

[56] References Cited

UNITED STATES PATENTS 3,721,084 3/1973 Dargent ..... 340/336

OTHER PUBLICATIONS

B351,493, Jan. 1975, Ingle, 340/336.

*Primary Examiner*—Marshall M. Curtis

*Attorney, Agent, or Firm*—F. David LaRiviere

[57] ABSTRACT

This specification describes a power control circuit for reducing the brightness of multi-segment light-emitting diode (LED) characters in proportion to the number of segments illuminated to compensate for the apparent greater brightness of those characters having more segments illuminated than others. Since brightness is a function of power, the power required to drive multi-segment characters is substantially reduced, which extends useful battery life of battery powered equipment having light-emitting displays. Since less power is required by the display, the power driving and dissipation capability of the drive circuitry is also reduced.

6 Claims, 1 Drawing Figure

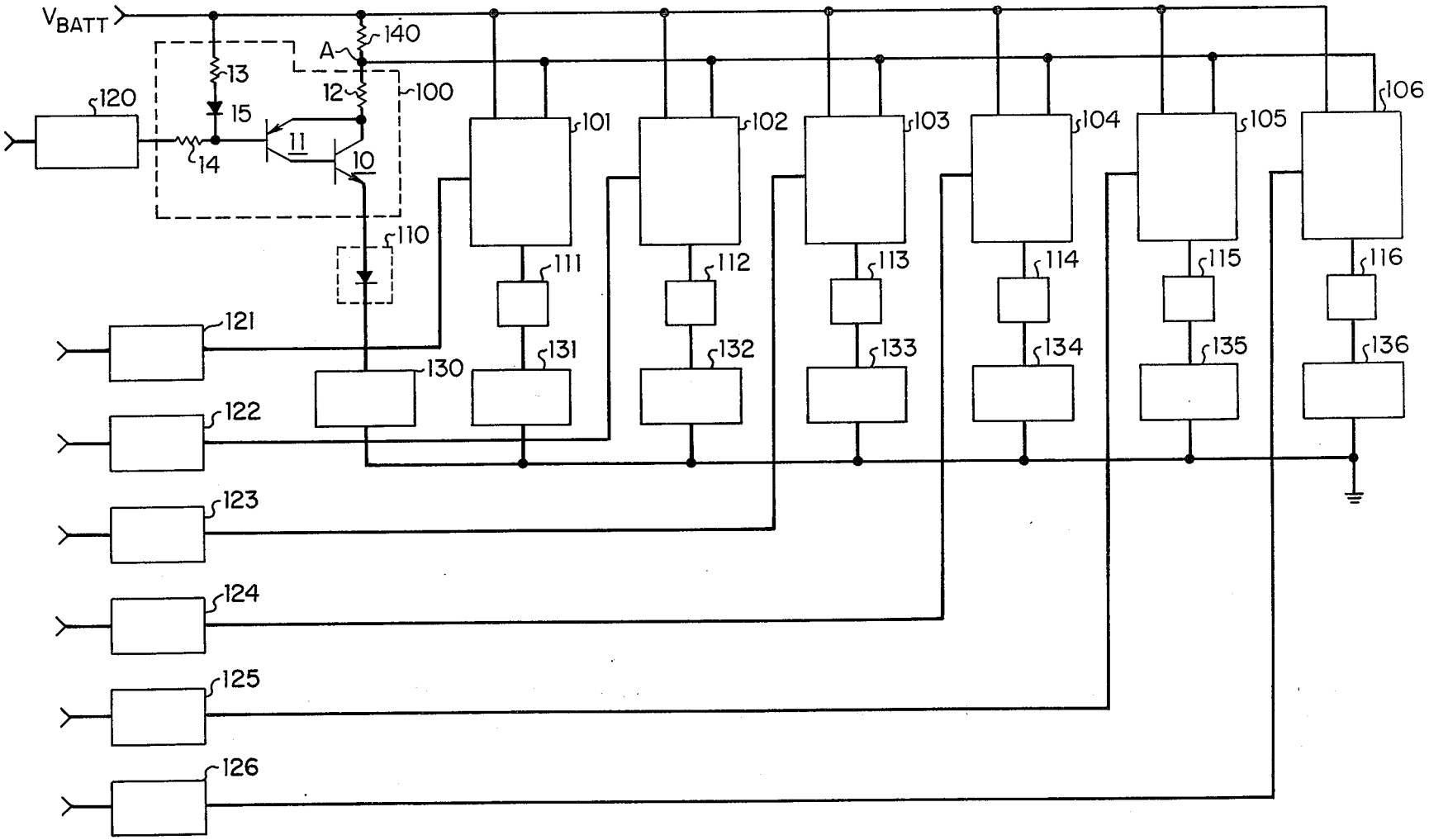
106
105
104
103
102
101
116
115
114
113
112
111
136
135
134
133
132
131
130
140
100
110
A
12
10
11
13
15
14
120
121
122
123
124
125
126
$V_{BATT}$

AUTOMATIC DISPLAY SEGMENT INTENSITY CONTROL

BACKGROUND & SUMMARY OF THE INVENTION

Each character is a typical prior art display usually comprising seven separate LED segments. Each segment is powered to provide substantially the same light emission even though fewer segments are illuminated in some characters than in others.

In a display of a series of different characters, characters having more segments illuminated than others appear to be brighter to most observers. This apparent difference in brightness is emphasized when a character having a few segments illuminated is immediately adjacent a character having many segments illuminated. Thus an 8 generally appears to be brighter than a 1.

The present invention compensates for this apparent brightness difference to provide a display of characters having apparently uniform brightness regardless of the number of segments illuminated per character or the number of different characters in the display. This compensation is achieved by including a power control circuit in the anode drive circuitry for each LED. The brightness per character is reduced approximately as the square root of the number of segments illuminated. Not only is the power required to drive characters having several segments illuminated substantially reduced using this scheme, but the necessary power drive capability of the driver circuitry is similarly reduced.

DESCRIPTION OF THE DRAWING

The drawing shows a block diagram of a seven-segment LED character including a schematic diagram of the power control circuits for each segment constructed according to the preferred embodiment of the present invention.

DESCRIPTION OF THE PREFERRED EMBODIMENT

Referring to the drawing, power control circuit 11 comprises transistors 10 and 11, resistors 12, 13 and 14, and diode 15 for controlling the power delivered to LED segment 110 in conjunction with resistor 140 as one or more of remaining segments 111, 112, 113, 114, 115 and 116 of the character are energized. These segments receive similarly controlled power via control circuits 101, 102, 103, 104, 105 and 106. The control circuits are driven by anode drivers 120, 121, 122, 123, 124, 125 and 126 respectively, and the cathode of each segment is controlled by cathode drivers 130, 131, 132, 133, 134, 135 and 136, respectively. The anode and cathode drivers are described more fully later in this specification.

As the power to each segment is reduced, its light emission is proportionately reduced. Referring now to control circuit 100 of the drawing, each segment receives less power individually as more segments are illuminated in accordance with the following analysis:

The combination of transistors 10 and 11 operate as a current source. The current supplied to LED segment 110 by transistor 10 is determined by a voltage drop across resistors 12 and 140 ($R_{12}$ and $R_{140}$) plus the base-emitter voltage ($V_{BE}$) of transistor 11. That voltage drop is controlled by a reference voltage comprising the voltage drop across $R_{13}$ and diode 15 which is established by input current through $R_{14}$. If the current through $R_{12}$ is $I_A$ and equal to the current through the respective resistors of the same value in circuits 101, 102, 103, 104, 105 and 106, then the current through $R_{140}$ is given by $I_{140} = nI_{12}$, where $n$ is the number of segments illuminated.

The voltage, $V_{140}$, across $R_{140}$ increases as more segments are turned on. However, assuming the voltage V, across $R_{13}$, diode 15 and the emitter-base junction of transistor 11 to be approximately constant, then $$V = V_{140} + V_{12}$$

where $V_{12}$ is the voltage across $R_{12}$. Since $I_{12}$ is equal for illuminated segments, $$V = I_{12} R_{140} + I_{12} R_{12} + (n-1) I_{12} R_{140},$$

where $(n-1)$
is remaining illuminated segments $$= I_{12} (R_{140} + R_{12} + (n-1) R_{140})$$

Therefore $$I_{12} = \frac{V}{nR_{140} + R_{12}} \qquad \text{(A)}$$

According to equation (A) therefore, the current through each segment is reduced in proportion to the number of segments illuminated.

The ratio of segment brightness to the number of segments illuminated can be set by selection of resistors $R_{140}$ and $R_{12}$. This ratio is typically $1/\sqrt{n}$ (where $n$ is the number of segments illuminated) for all digits in a random display to appear equal in brightness to most observers.

Using the above described control circuit, the brightness of the segments in an 8 is reduced yet the digit itself appears to be equal in brightness to a 1. With reduced brightness, commensurately less power is required for multi-segment characters. A 50% reduction of display current is typically obtainable. Since less power is required, the power delivery capability of the anode driver and the cathode driver may be reduced also. Typically, up to 25% less area (for power dissipation) is necessary in IC anode and cathode drivers. This reduction of display power requirement thus extends useful battery life for battery-powered equipment having light-emitting displays.

The anode and cathode drivers are essentially the same as those disclosed in U.S. Pat. application Ser. No. 302,371 filed by France Rode et al. on Oct. 30, 1972. Any equivalent circuit for the drivers which is compatible with the display logic control circuitry, the control scheme herein described and the LED's selected for display may be used. While power control has been described in connection with the anode drive circuitry for each LED, an analogous scheme could be devised in the cathode drive circuitry.

While the preferred embodiment of the present invention has been described for light-emitting displays comprising LED's, the principles of this invention readily apply to any electrically powered light-emitting display which includes characters made up of separately powered light-emitting segments.

I claim:

1. Apparatus for controlling the power to a display character having a plurality of light-emitting segments, said apparatus comprising:

a plurality of command circuits for producing command signals;

a plurality of electrical power sources coupled to the command circuits and the light-emitting segments for applying electrical power thereto in response to the command signals; and proportioning means coupled to the electrical power sources for controlling the amount of electrical power applied to the light-emitting segments in proportion to the number of light-emitting segments energized to form the character.

2. The apparatus as in claim 1 wherein the proportioning means reduces the amount of power applied to the light-emitting segments as the number of light-emitting segments energized increase.

3. The apparatus as in claim 2 wherein the light-emitting segments are light-emitting diodes.

4. Apparatus for improving the uniformity of intensity of illumination of a plurality of display characters which comprise a plurality of light-emitting diode segments energized as a function of the number of those segments illuminated, said apparatus comprising for each of said display characters;

a plurality of command circuits for producing command signals;

a plurality of electrical power sources coupled to the command circuits and the light-emitting diode segments of the character for applying electrical power thereto in response to command signals; and proportioning means coupled to the electrical power sources for controlling the amount of electrical power applied to the light-emitting diode segments in proportion to the number of light-emitting diode segments energized;

said brightness of the light-emitting diode segments changing in response to the number of light-emitting diode segments energized.

5. Apparatus as in claim 4 wherein the intensity of illumination of each light-emitting diode segment varies as the inverse of the square root of the number of light-emitting diode segments illuminated.

6. Apparatus as in claim 4 wherein the proportioning means reduces the amount of power applied to the light-emitting diode segments as the number of light-emitting diode segments energized increases.

* * * * *